US005937549A

United States Patent [19]

Bender et al.

[11] Patent Number: 5,937,549

[45] Date of Patent: Aug. 17, 1999

[54] WEAR MEMBER ATTACHMENT SYSTEM

[75] Inventors: John L. Bender, East Peoria; Richard E. Livesay, Peoria; Chris J. Stickling, Dunlap, all of Ill.

[73] Assignee: Caterpillar Inc., Peoria, Ill.

[21] Appl. No.: 08/825,822

[22] Filed: Mar. 31, 1997

Related U.S. Application Data

[63] Continuation-in-part of application No. 08/691,778, Aug. 8, 1996, abandoned.

[51] Int. Cl.[6] ..... E02F 9/28

[52] U.S. Cl. ..... 37/455; 37/446; 172/772

[58] Field of Search ..... 37/451, 452, 453, 37/450, 455, 456; 172/772, 772.5, 753, 713, 719, 749; 299/91, 92

[56] References Cited

U.S. PATENT DOCUMENTS 5,005,304 4/1991 Briscoe et al. ..... 37/141 R
5,063,695 11/1991 Briscoe et al. ..... 37/141 R
5,241,765 9/1993 Jones et al. ..... 37/398
5,427,186 6/1995 Adrian et al. ..... 172/701.3
5,438,774 8/1995 Fletcher et al. ..... 37/456
5,564,508 10/1996 Renski ..... 172/772

*Primary Examiner*—Thomas B. Will
*Assistant Examiner*—Robert Pezzuto
*Attorney, Agent, or Firm*—O Gordon Pence

[57] ABSTRACT

Replaceable wear members used in the past have usually includes shortcomings which have caused the product to be less than desirable. The present system for attaching a wear member to a parent member provides many advantages over the past configurations. For example, the unique configuration of the mounting base and wear member include cooperating slide and place engagement elements for mounting purposes. Also, a unique low profile retainer is used to retain the wear member, which allows for more use of the wear member before replacement is required, thus resulting is less throw-away material.

20 Claims, 12 Drawing Sheets

WEAR MEMBER ATTACHMENT SYSTEM

This is a Continuation-in-Part of application Ser. No. 8/691,778, filed Aug. 8, 1996 now abandoned.

TECHNICAL FIELD

This invention relates generally to a replaceable wear member and more particularly to a system for attaching the replaceable wear member to a parent member of an earthmoving machine.

BACKGROUND ART

Replaceable wear members for protecting structural members such as those of a bucket or truck body are well known in the art. These replaceable wear members are retained by a variety of fastening methods. Most, if not all, of the heretofore fastening methods have shortcomings that cause them to be less than desirable.

For instance, welding has been frequently used to attach wear members. However, welding is expensive and time consuming and makes removal and replacement of the wear member an equally expensive and time consuming task. Various types of mechanical fasteners have also been used, but with varying degrees of success because of their complexity, unreliability and cost.

The primary features desired for a wear member are that it have a long life and be as completely used up as possible to minimize the amount of metal that has to be thrown away after it wears out. For the system for retaining the wear member, the desired features are that it be able to live in and be able to withstand the harsh environment in which it operates, that it be failure free throughout the useful life of the wear member, and that it permits quick and easy installation and removal of the wear member. Some of the prior known wear members and fastening systems provide some of these desired features, but lack others, which make them less than desirable.

The present invention is directed to overcome one or more of the problems as set forth above.

DISCLOSURE OF THE INVENTION

In one aspect of the invention, a mechanical attachment system is provided for detachably mounting a wear member to a parent member of an earthmoving machine. The mechanical attachment system includes a mounting base carried on the parent member, having an outward surface, a retainer opening in the outward surface and a pair of opposed catch elements. The wear member has a retainer passage therethrough, which is alignable with the retainer opening in the mounting base. Cooperating place and slide engagement elements on each of the mounting base and the wear member permit place and slide mounting of the wear member onto the mounting base. The place and slide engagement elements include a first abutment surface on the mounting base and a second abutment surface on the wear member. A retainer has a pair of opposite sides and a convoluted spring portion. The retainer is adapted for receipt through the retainer passage and the spring portion provides the retainer with sufficient resiliency to permit the insertion of the retainer into the retainer opening, wherein the retainer is engaged and retained by the catch elements and wherein the first and second abutment surfaces are disposed in spaced opposing relationship to each other and have an abutting relationship to a respective one of the opposite sides of the retainer at a location under the outward surface of the mounting base.

In another aspect of the invention, a wear member is provided for protecting a parent member of an earthmoving machine from abrasive wear and includes a body portion having a longitudinal axis, a mounting side and an opposite wear exposed side. The mounting side has a mounting base receiving pocket formed therein having opposite ends spaced apart along the longitudinal axis. A retainer passage therethrough extends from the wear exposed side into the pocket. The retainer passage has opposite sides extending transversely to the longitudinal axis. Cooperating place and slide engagement elements enable the mounting of the wear member onto a mounting base carried on the parent member. The place and slide engagement members include a first abutment disposed adjacent one end of the pocket and a second abutment disposed adjacent the opposite end of the pocket. The abutments are centrally located along the longitudinal axis with the retainer opening being disposed therebetween. Each abutment has a set of external dovetail surfaces on opposite sides thereof for use in attaching the wear member to the mounting base and one of a pair of opposing surfaces. The opposing surfaces are disposed in spaced opposing relationship to each other and oriented in a direction transverse to the longitudinal axis. One of the pair of opposing surfaces are aligned with one of the sides of the retainer passage.

BEST MODE FOR CARRYING OUT THE INVENTION

Figure 1:
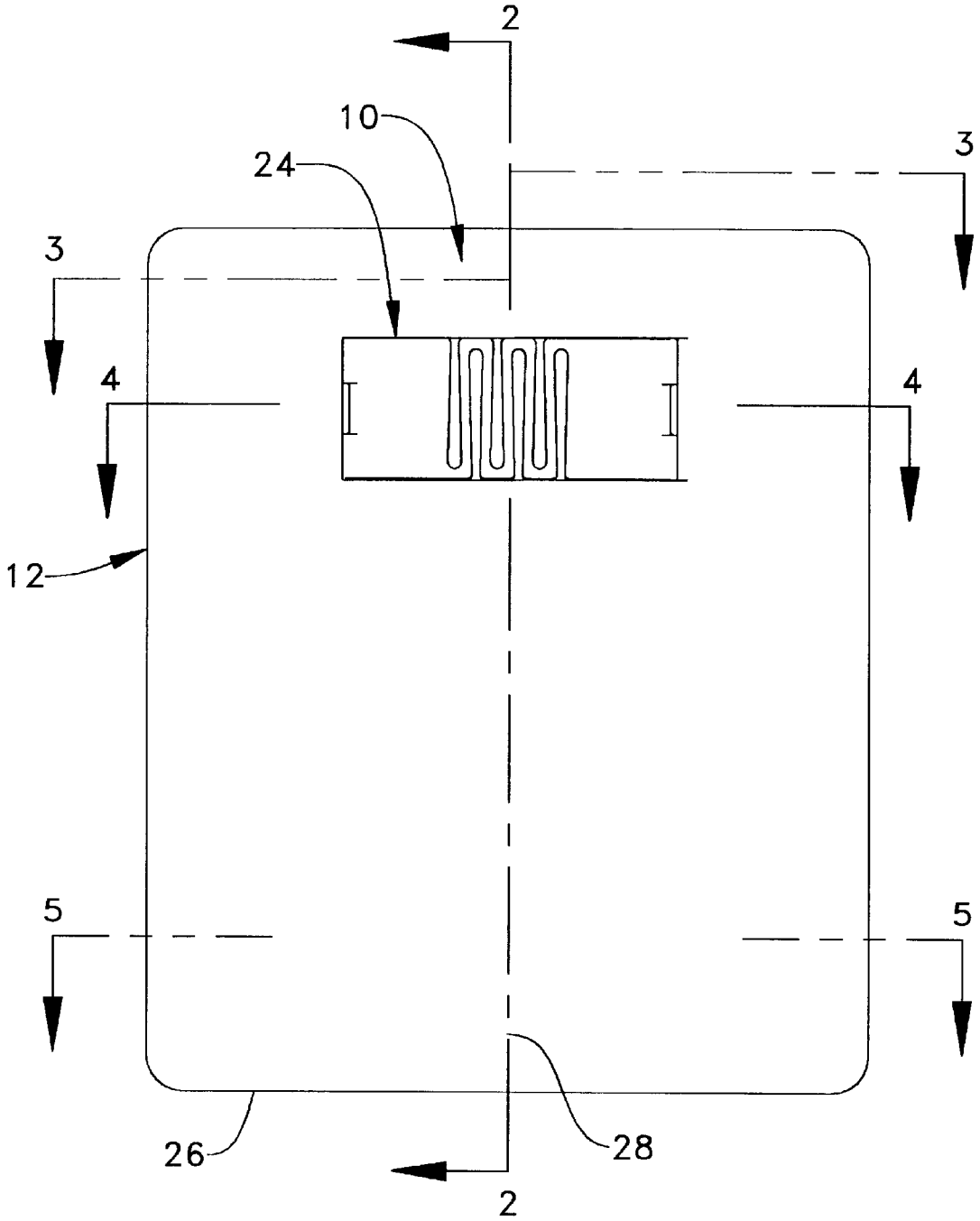
FIG. 1 is a diagrammatic top view of one application the mechanical attachment system embodying the principles of the present invention.
Figure 2:
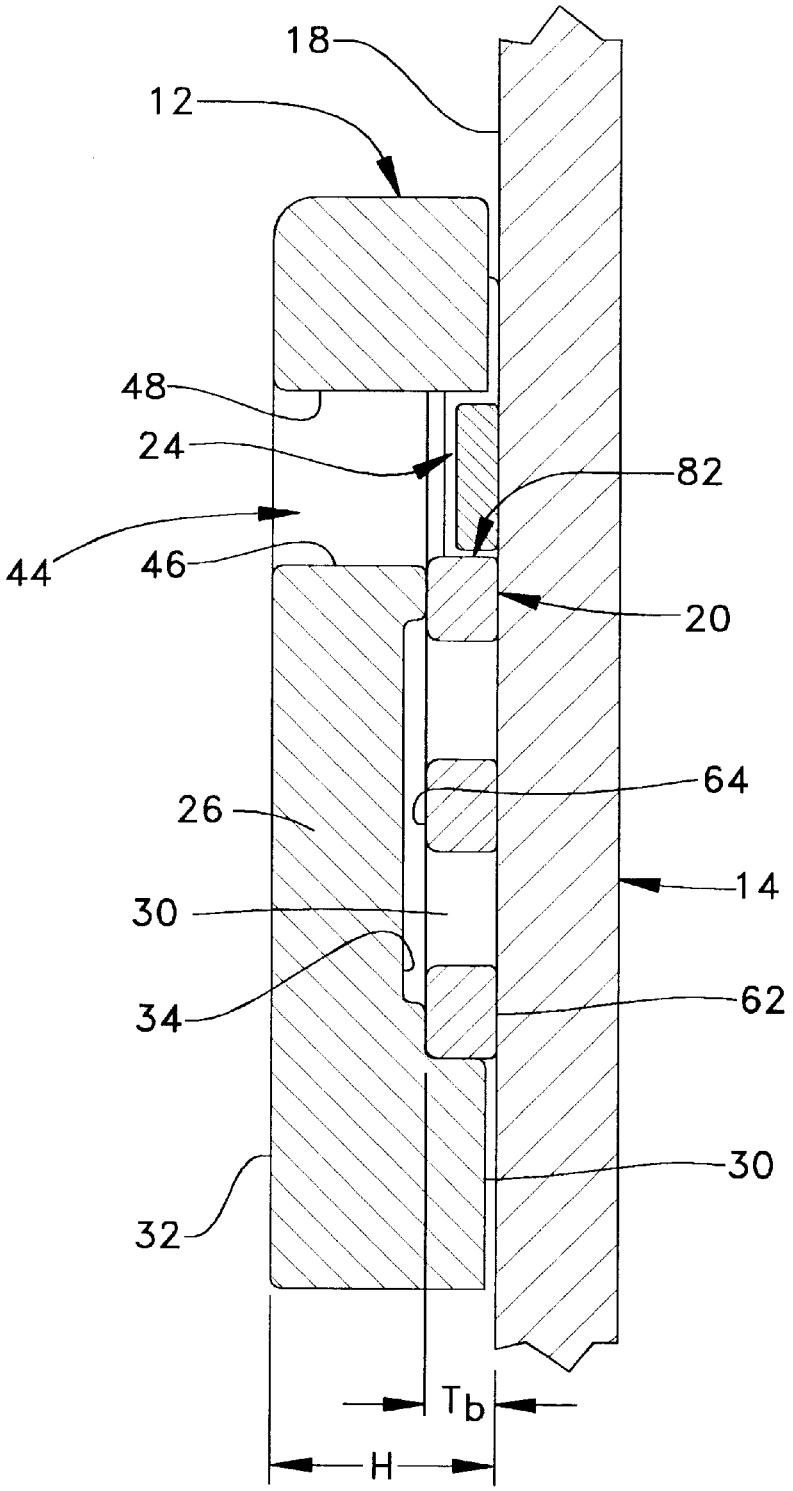
FIG. 2 is a diagrammatic cross-sectional view of the attachment system of present invention depicted in FIG. 1 taken along line 2—2 of FIG. 1.
Figure 3:
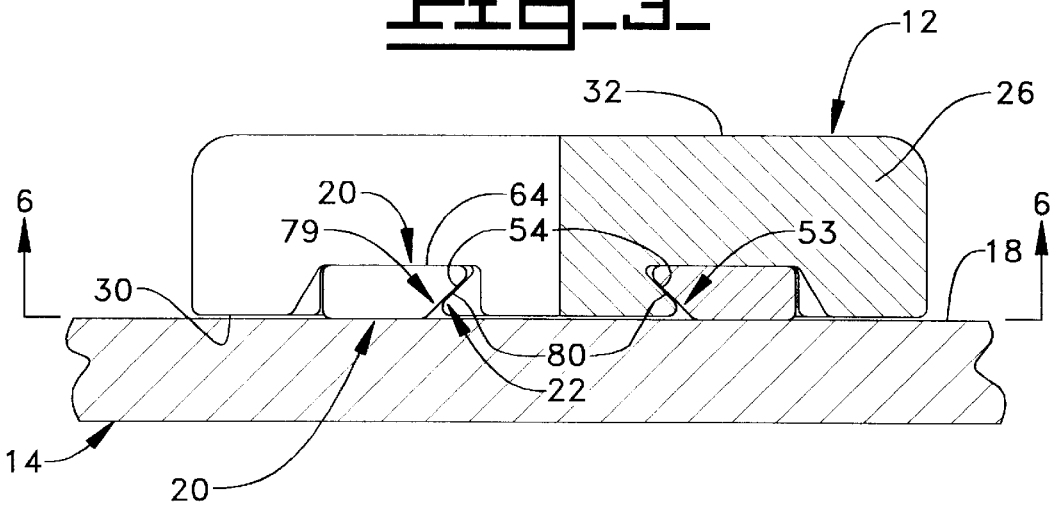
FIG. 3 is a diagrammatic cross-sectional view of the present invention taken along line 3—3 of FIG. 1.
Figure 4:
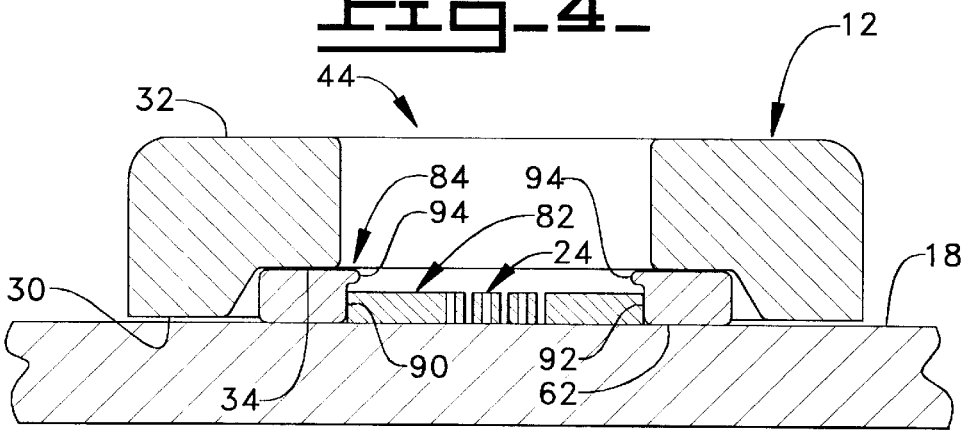
FIG. 4 is a diagrammatic cross-sectional view of the present invention taken along line 4—4 of FIG. 1.
Figure 5:
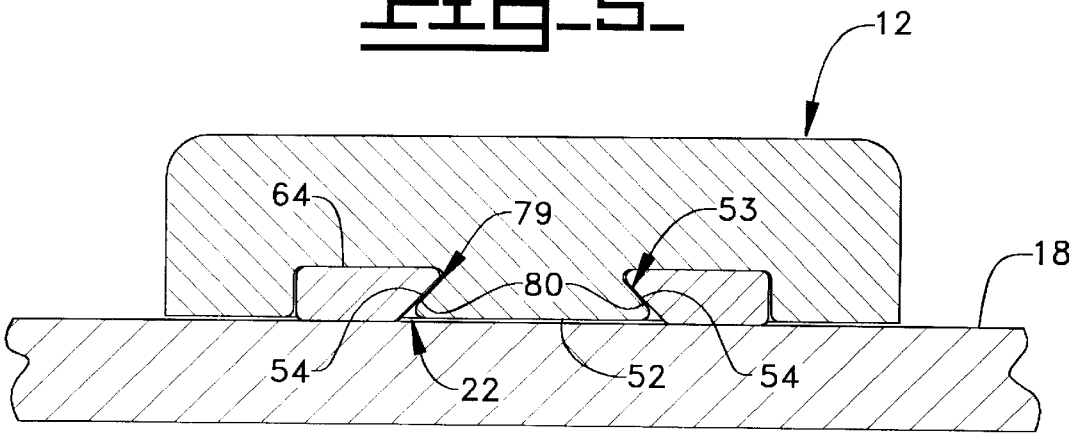
FIG. 5 is a diagrammatic cross-sectional view of the present invention taken along line 5—5 of FIG. 1.
Figure 6:
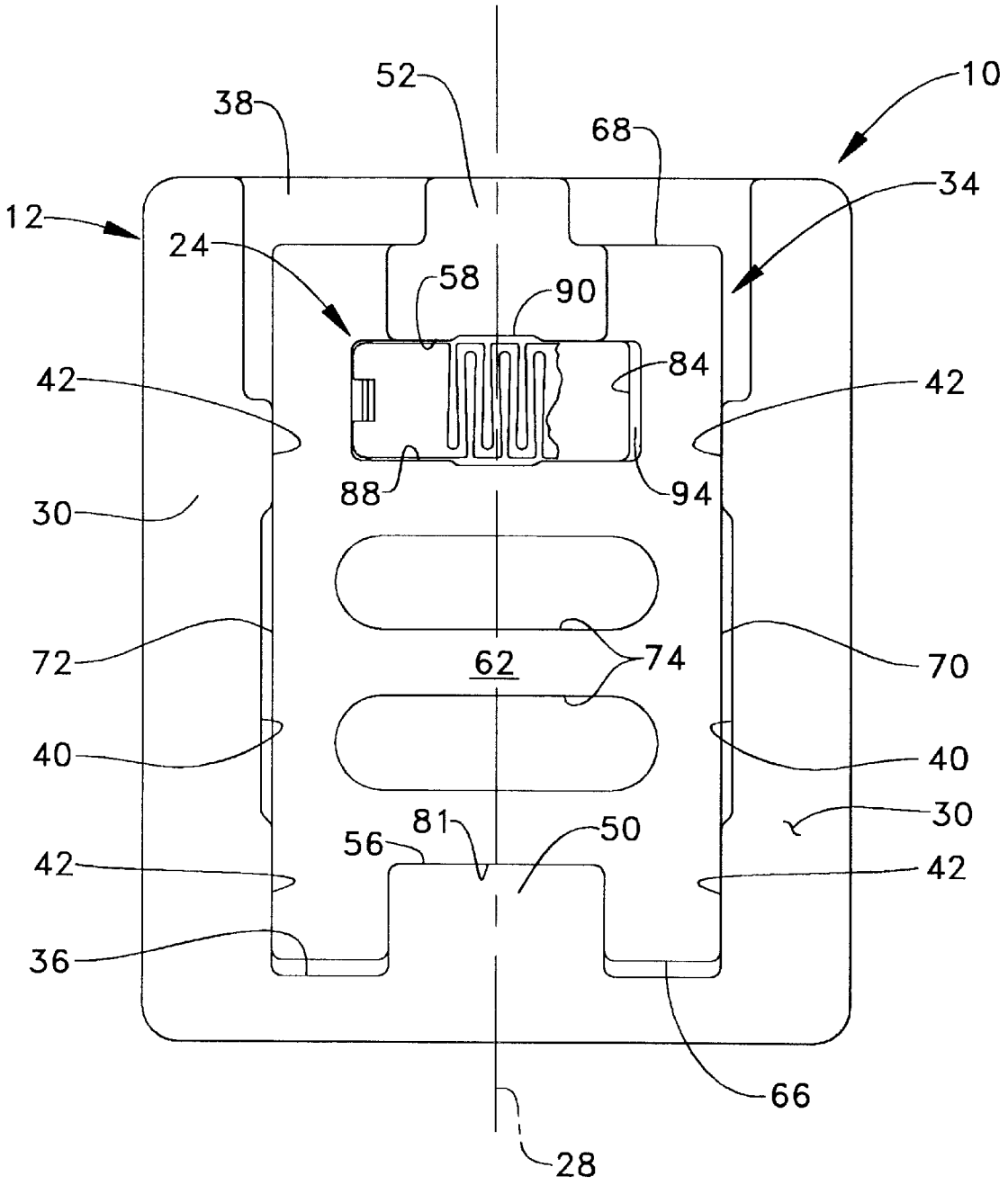
FIG. 6 is a diagrammatic bottom view of the attachment system of the present invention taken along line 6—6 of FIG. 3.

Referring more particularly to the drawings, a mechanical attachment system is generally shown at 10 for detachably mounting a wear member 12 to a parent member 14 of an earthmoving machine (not shown).

In a first embodiment of this invention disclosed in FIGS. 1–6, the system 10 is adapted for detachably mounting the wear member 12, which in this case is in the form of a wear tile, onto a parent member 14 (FIG. 2), which is in the form of a bottom base edge of a bucket (not shown). The bottom base edge or parent member 14 has a surface 18 to be protected from abrasive wear. In addition to the wear member 12, the system 10 includes a mounting base 20, cooperating place and slide engagement elements 22 (FIG. 3) on each of the mounting base 20 and the wear member 12 to permit place and slide mounting of the wear member 12 onto the mounting base 20, and a retainer 24 (FIG. 4) for keeping the wear member 12 on the mounting base 20 during use.

A plurality of wear members 12 may be attached to a bucket. Typically such wear members are attached to the bottom surface of the base edge of the bucket at a location, for instance, to the rear of the cutting edge of such bucket.

The wear member 12 includes a generally rectangular planar body portion 26 that is disposed along a longitudinal axis 28, a mounting side 30 and an opposite wear exposed side 32. The mounting side 30 has a mounting base receiving pocket 34 formed therein. The pocket 34 has opposite ends 36,38 (FIG. 6) spaced apart along the longitudinal axis 28. The pocket 34 also has opposite, longitudinally extending sides 40, which have abutment surfaces 42 disposed therealong. A retainer passage 44 (FIG. 2) is provided through the body portion 26, extending from the wear exposed side 32 into the pocket 34. The retainer passage 44 (FIG. 2) has opposite sides 46,48 extending transversely to the longitudinal axis 28.

A first abutment 50 (FIG. 6) is disposed adjacent one end 36 of the pocket 34 and a second abutment 52 is disposed adjacent the opposite end 38 of the pocket. The abutments 50,52 are centrally located along the longitudinal axis 28 of the wear member. Either abutment 50,52 may have a first set of interlocking surfaces 53. More preferably, each abutment is provided with an external set of dovetail surfaces 54 (FIGS. 3 & 5) on opposite sides thereof for use in attaching the wear member 12 to the mounting base 20, which form part of the place and slide engagement 22 hereinafter more fully described. Abutment 52 provides a second abutment surface 58, while abutment 50 provides a fourth abutment surface 56. The abutment surfaces 56,58 (FIG. 6) are disposed in spaced opposing relationship to each other and are oriented in a direction transverse to the longitudinal axis 28. Abutment surface 58 is also aligned with one of the sides 48 of the retainer passage 44 of the wear member 12.

Figure 7:
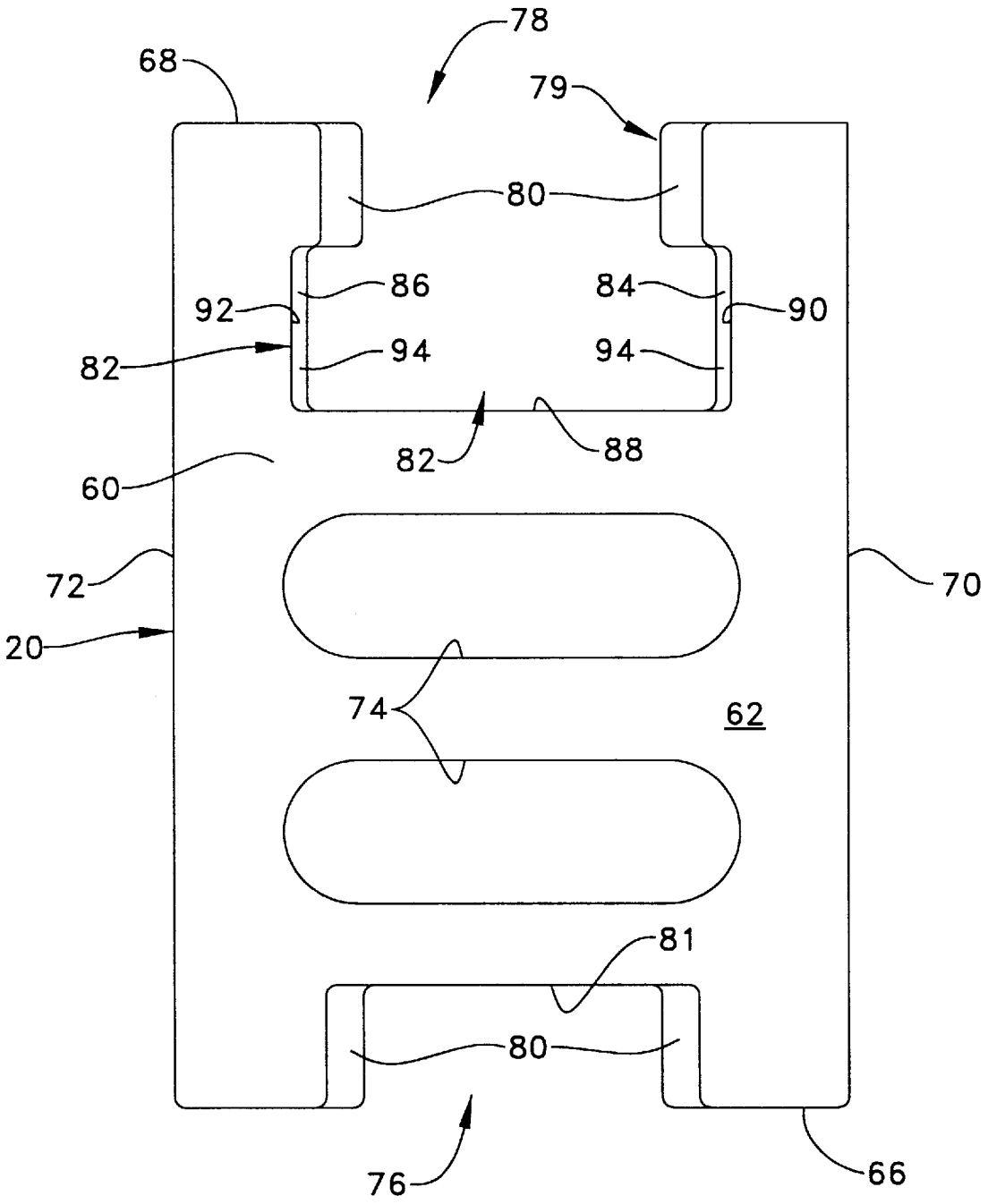
FIG. 7 is a diagrammatic bottom view similar to FIG. 6, but of the mounting base of the attachment system shown by itself.

The mounting base 20 is carried on the parent member 14 and includes a generally planar rectangular body portion 60 (FIG. 7) disposed along the longitudinal axis 28. The mounting base 20 has an inward surface 62 contacting the exposed surface 18 of the parent member 14, an opposite outward surface 64, a pair of opposite ends 66,68 transverse to the longitudinal axis and a pair of sides 70,72 parallel to the longitudinal axis. Preferably, the mounting base 20 is secured to the parent member by welding. To facilitate such welding, the mounting base 20 may be provided with a pair of generally oval shaped weld openings 74 therethrough for receiving fillet welds.

A first notch 76 is located at one end 66 of the body 60, while a second notch 78 is located at the opposite end 68. Either of such notches 76,78 may have a second set of interlocking surfaces 79. More preferably, each of the notches 76,78 are provided with a set of longitudinally extending internal dovetail surfaces 80, which are adapted to mate with the external dovetail surfaces 54 on the wear member 12. The first notch 76 also includes a third abutment surface 81 which is disposed in an opposing relationship to the fourth abutment surface 56 of abutment 50.

The mounting base 20 also includes a retainer opening 82 in the outward surface 64 thereof. The retainer opening 82 is contiguous to the second notch 78 and is disposed between the first abutment 50 and the second abutment 52. The retainer opening 82 has a first abutment surface or side 88 opposing such notch 78, a pair of opposite ends 90,92 and a pair of opposed catch elements 84,86. The catch elements 84,86 are preferably formed by an inwardly extending flange 94 on each of the ends 90,92 for use in retaining a retainer (hereinafter described) in the retainer opening.

Figure 8:
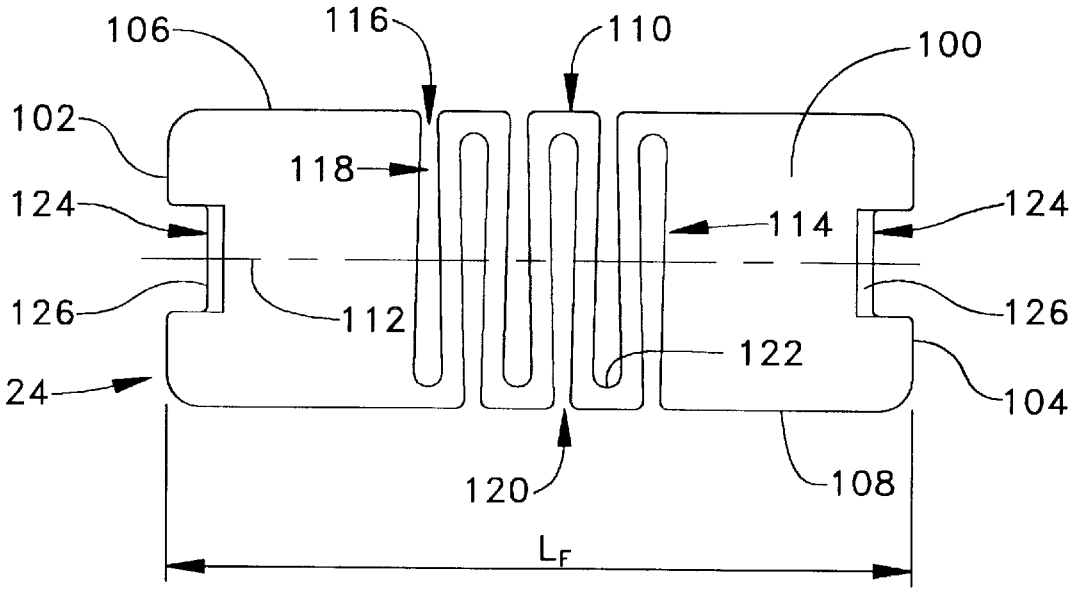
FIG. 8 is a diagrammatic top view of a retainer member shown at its predetermined free-length configuration of the present invention.
Figure 9:
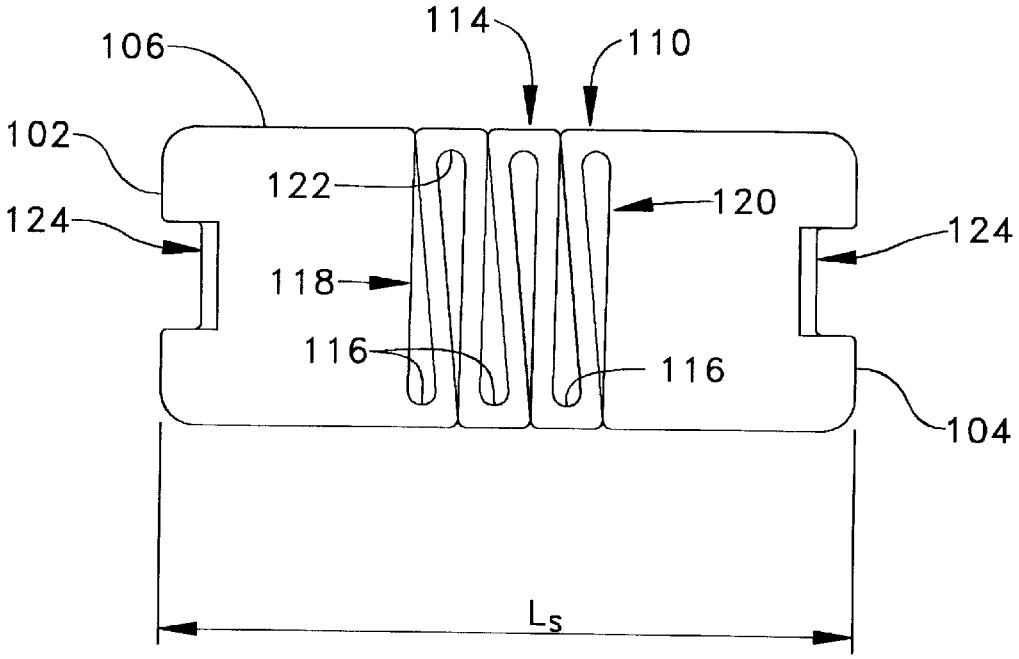
FIG. 9 is a diagrammatic top view of the retainer member shown at its predetermined shorter compressed length configuration of the present invention.
Figure 10:
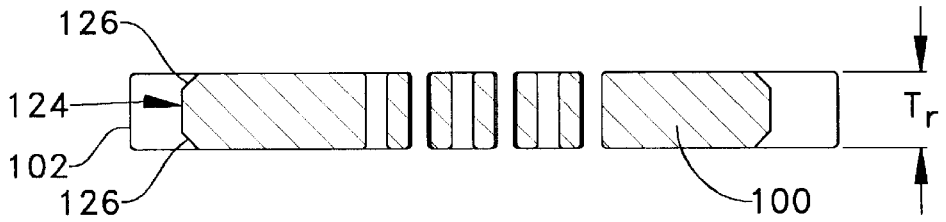
FIG. 10 is a diagrammatic partially cross-sectional view of the retainer shown in FIGS. 8 & 9.

As best shown in FIGS. 8–10, the retainer 24 has a generally flat body portion 100 which is adapted for placement within the retainer opening 82 of the mounting base 20. The body portion 100 includes a pair of opposite ends 102,104 and a pair of opposite sides 106,108. The body is preferably constructed of steel, but may be made of any suitable substantially non-compressible material, which is well known in the art. The retainer 24 is also provided with a convoluted spring portion 110 along the body 100, which is adapted to provide the body 100 with sufficient resiliency from end to end along its longitudinal axis 112 to permit the length of the body to be changed from a predetermined free length "$L_f$" from end to end to a shorter compressed length "$L_s$" when a compressive force is applied to the ends 102,104 of the body, but being sufficiently rigid from side to side to enable the retainer 24 to withstand compressive loads applied to the sides without incurring any significant distortion.

The convoluted spring portion 110 has a convolute 114 that runs back and forth from one side 106 of the retainer to the other side 108 thereof as it progresses along the longitudinal axis 112. The convolute 114 is formed by a plurality of interleaved slots 116 cut into the body portion 100, with a first set of slots 118 extending from one of the sides 106 toward the other side 108 and with a second set of slots 120 being disposed between adjacent ones of the first set of slots 118 and extending from the other of the sides 108 toward the one side 106.

In the embodiment of the retainer 24 shown in FIGS. 8–10, the interleaved slots 116 are somewhat tear-dropped in shape, with a radiused end 122 to reduce bending stresses when the retainer is compressed. Each of the opposite ends 102,104 are preferably provided with a pry tool notch 124 with a beveled bottom 126 adapted to allow the insertion of a pry tool, such as a flat bladed screw driver, for compressing the retainer for removal purposes.

Figure 11:
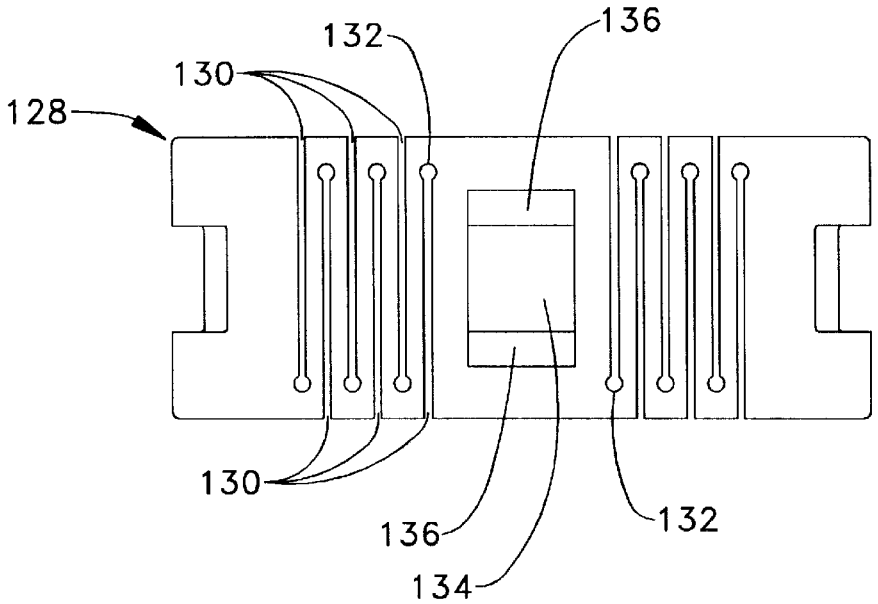
FIG. 11 is a diagrammatic top view of an alternate embodiment of a retainer of the present invention.

In another embodiment of the retainer shown in FIG. 11, a retainer 128 is disclosed wherein the interleaved slots 130 have straight sides and have a bulbous end 132 for stress relief purposes. Retainer 128 also has a central pry tool opening 134 having beveled ends 136. The remainder of retainer 128 may be similar to the first retainer 24.

Figure 12:
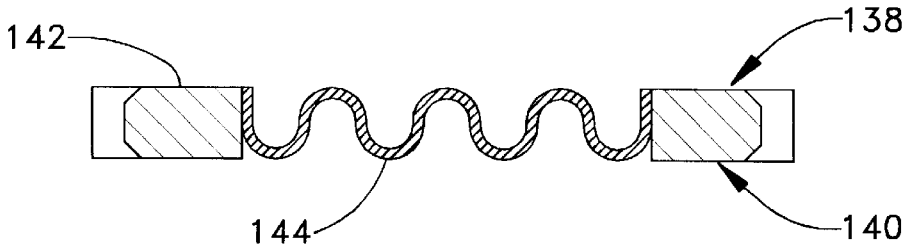
FIG. 12 is a diagrammatic cross-sectional view of another alternative embodiment of a retainer the present invention.

A further embodiment of the retainer is shown in FIG. 12 wherein a retainer 138 is of a fabricated composite construction having two separate end portions 140,142 and a separate spring element 144 having an accordion configuration and which is attached to and extends between the end portions 140,142.

The cooperating place and slide engagement elements 22 include the first abutment 50 and the first set of interlocking surfaces 53 on the wear member 12 and a second abutment, provided by the transverse abutment surface 81, and the second set of mating interlocking surfaces 79 on the mounting base 20, as previously described, which permit place and slide mounting of the wear member 12 onto the mounting base 20 such that when the wear member is placed onto the mounting base by movement in one direction and then slid in a transverse direction thereto the abutments are brought together to prevent further movement in the transverse direction and the interlocking surfaces are brought into an opposing interlocking relationship with each other whereby movement of the wear member is restricted in any direction other than in a direction of movement opposite to the transverse direction.

Figure 13A:
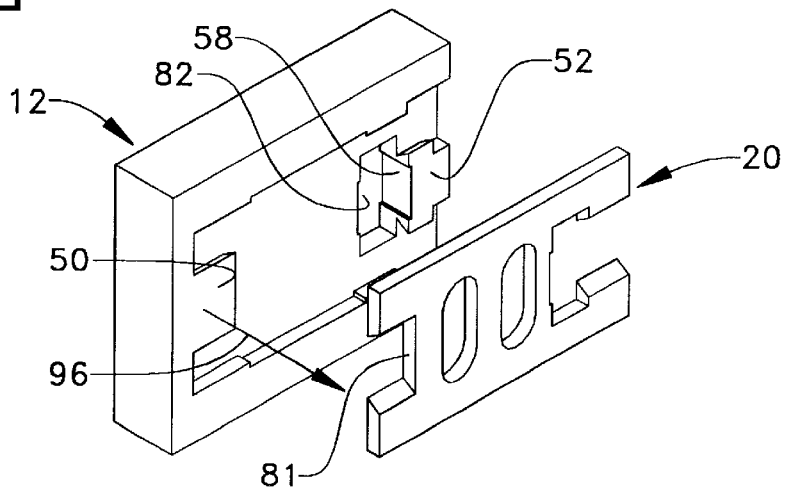
FIG. 13A–13C are sequential diagrammatic perspective views illustrating the assembly of the wear member onto the mounting base.
Figure 13B:
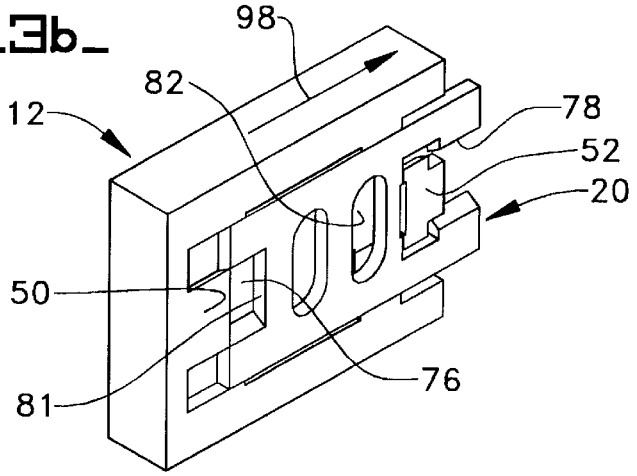
Figure 13C:
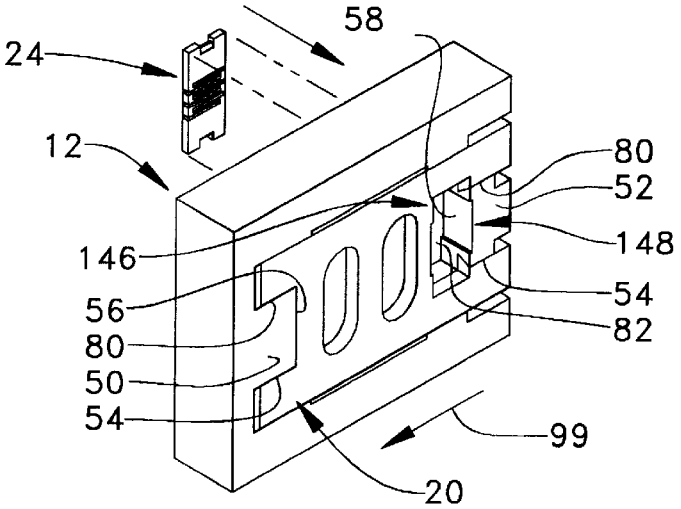
Figure 14:
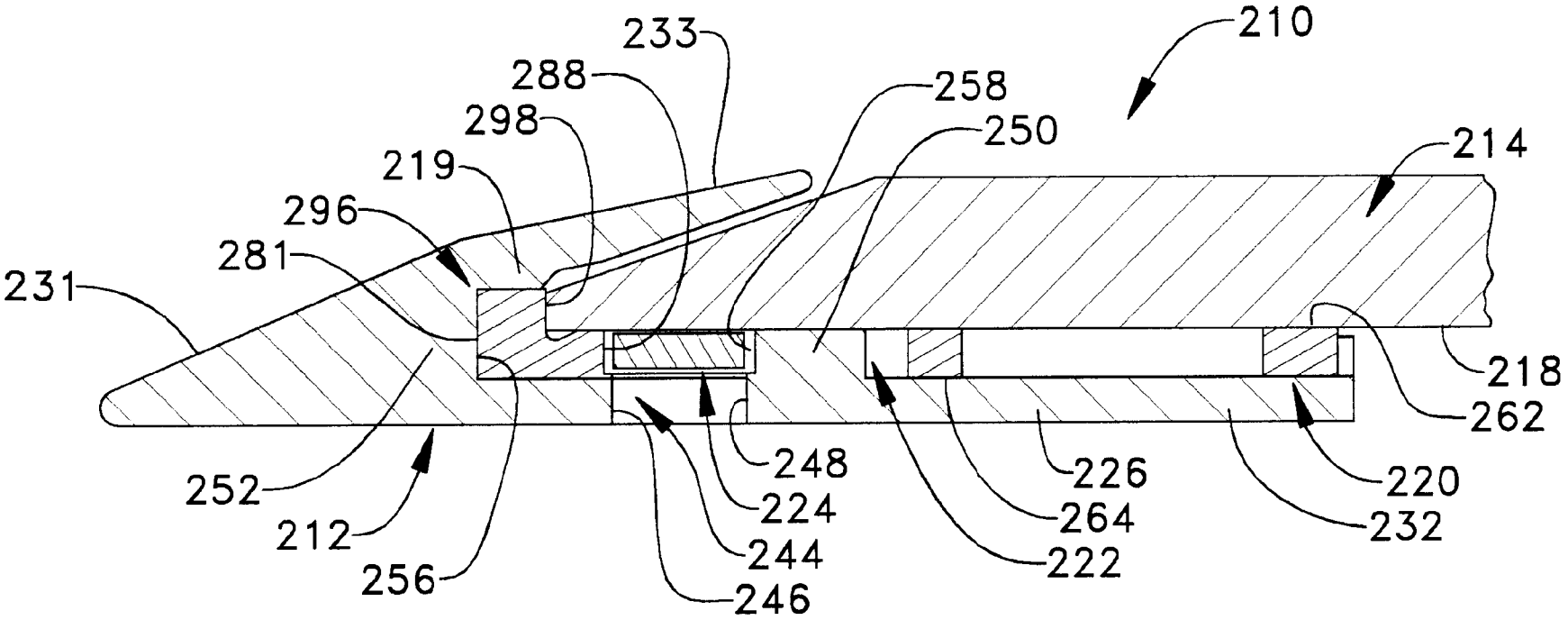
FIG. 14 is a diagrammatic cross-sectional view of a second application of the mechanical attachment system embodying the principles of the present invention.
Figure 15:
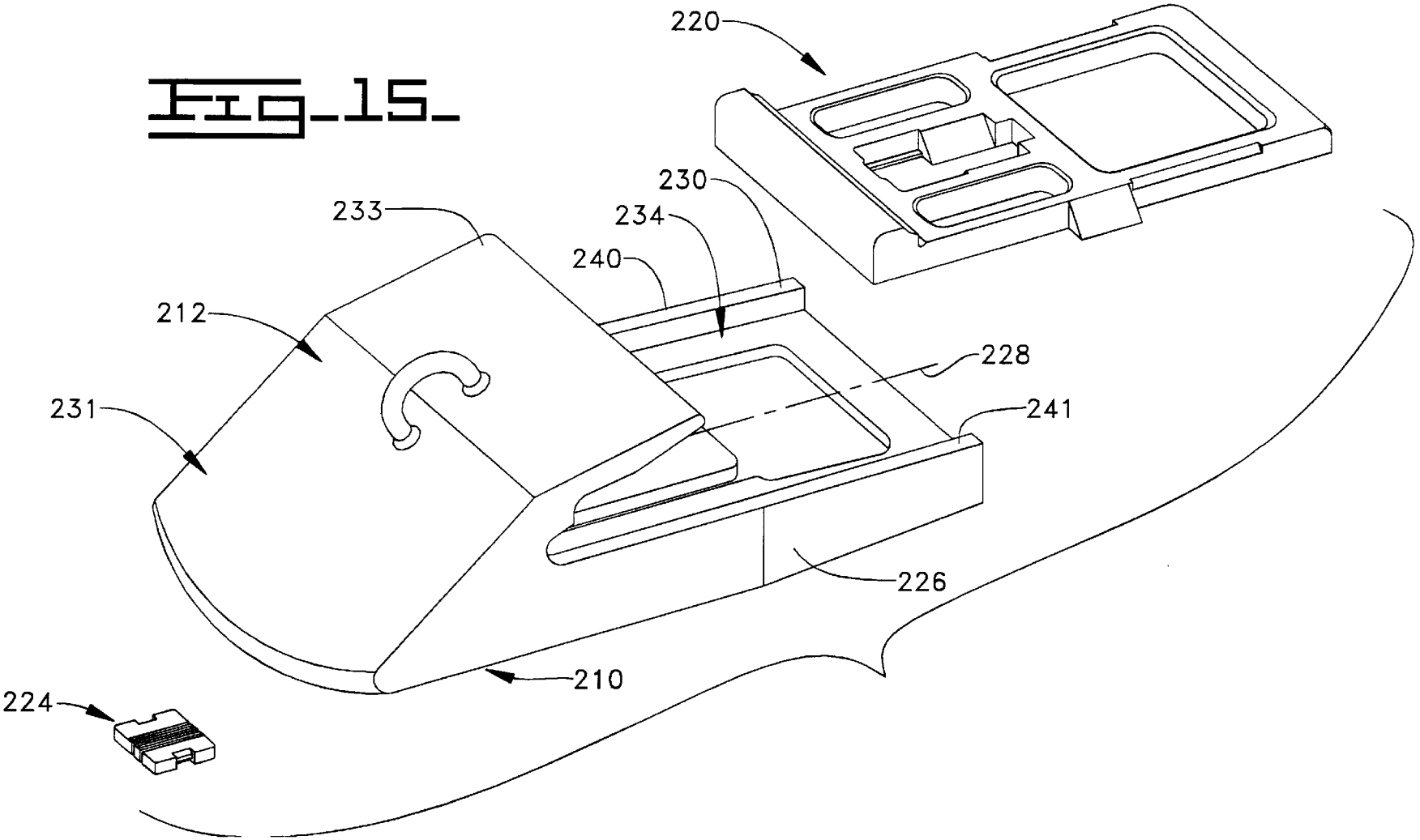
FIG. 15 is a diagrammatic exploded frontal perspective view of the components of the present invention illustrated in FIG. 14.
Figure 16:
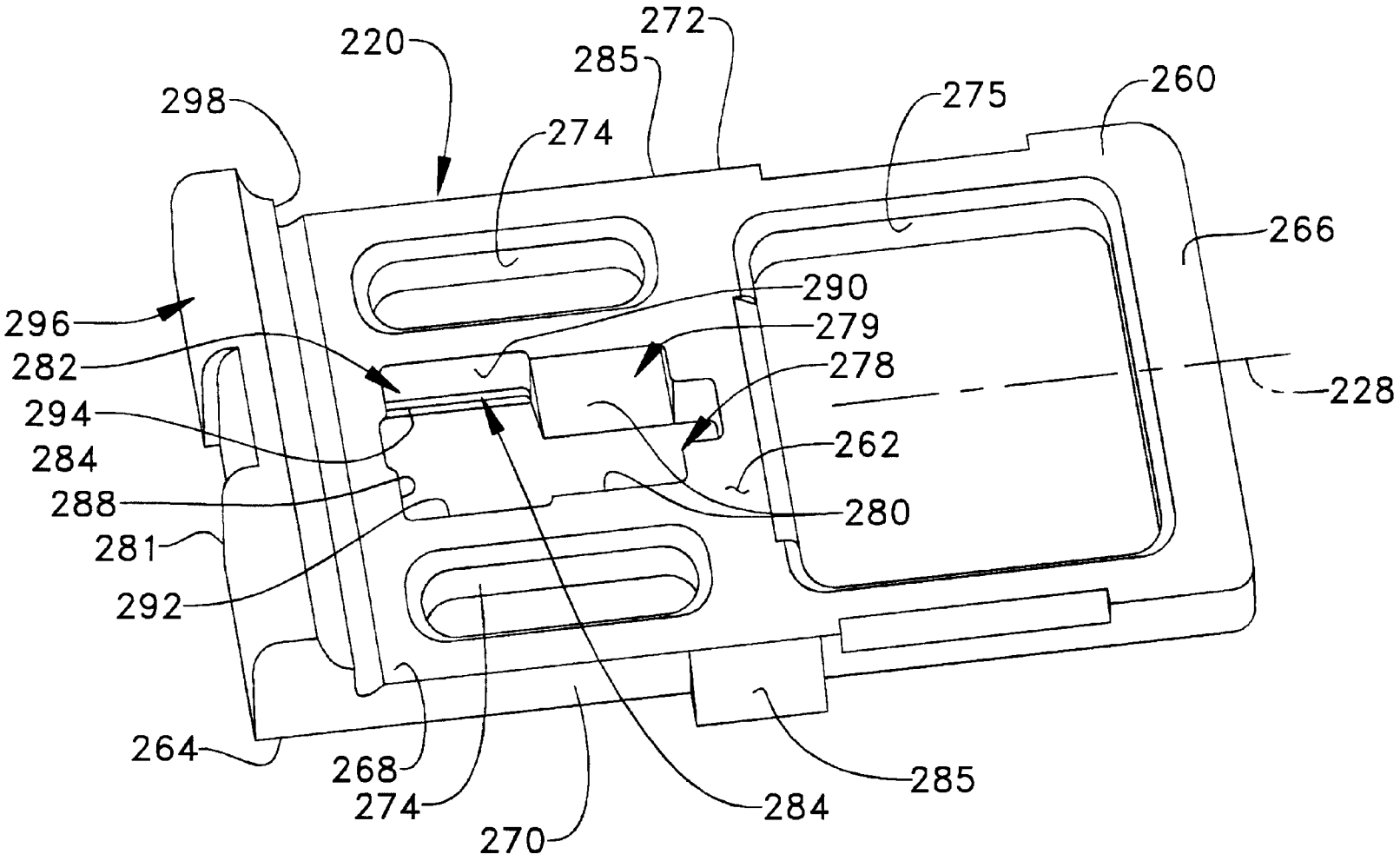
FIG. 16 is a diagrammatic perspective view of a base member illustrated in FIG. 14 by itself.
Figure 17:
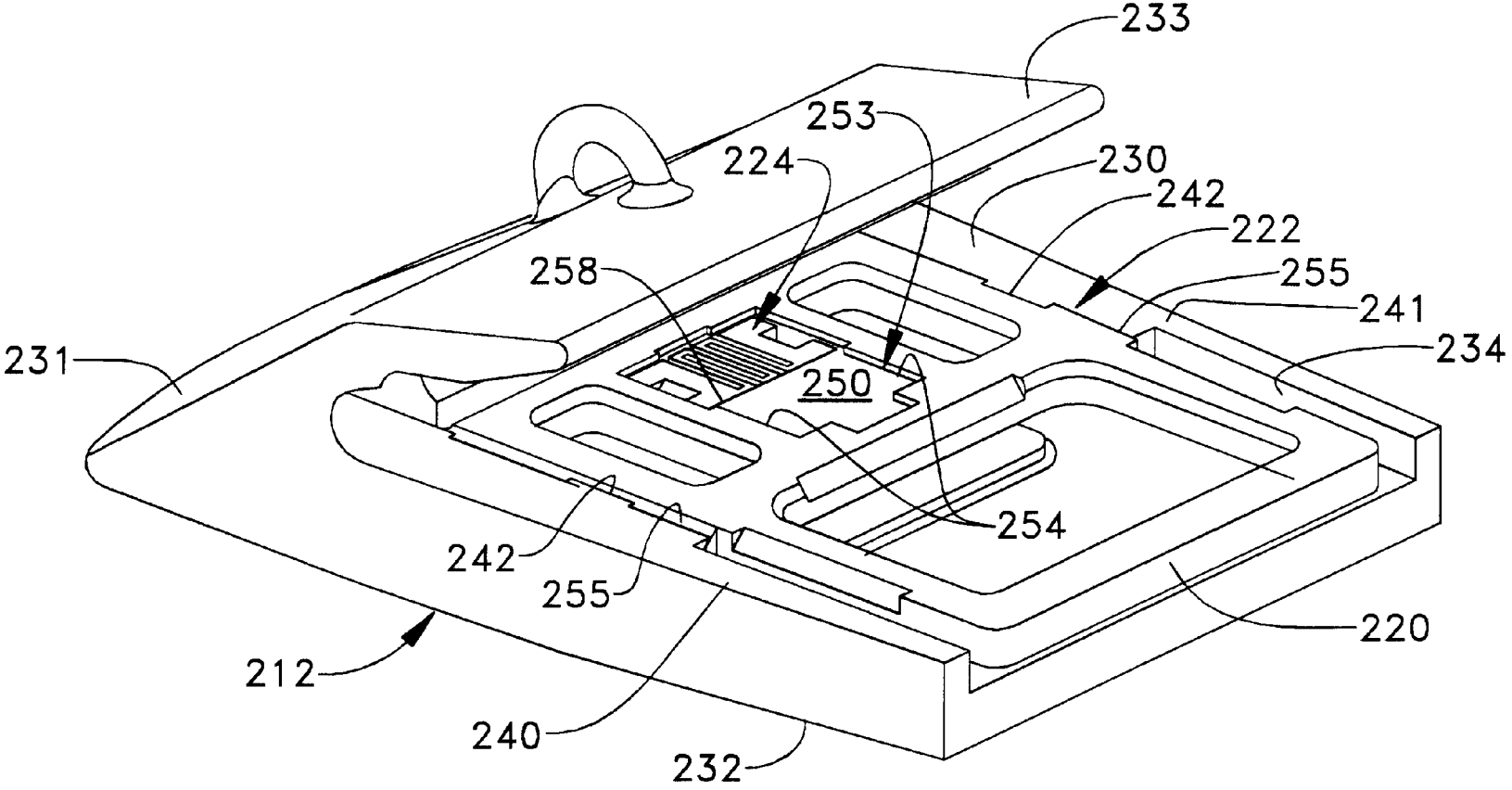
FIG. 17 is diagrammatic rearward perspective view of the present invention.

As depicted in FIGS. 13A–13C, place and slide mounting refers to the acts of placing the wear member 12 onto the mounting base 20 by movement of the wear member 12 in one or a first direction toward the mounting base 20 as shown by arrow 96 in FIG. 13A. As shown in FIG. 13B, the wear member 12 is first positioned on the mounting base 20 in an offsetting position where the first abutment 50 is to the left of the first notch 76 and the second abutment 52 is disposed within the retainer opening 82 and offset to the left from the second notch 78. The wear member 12 is then slid to the right in a second transverse direction, as shown by arrow 98, into a mounted position, as shown in FIG. 13C, so that the mating dovetail surfaces 54,80 on the abutments 50,52 and in the notches 76,78 are brought into an opposing interlocking relationship with each other. It should also be noted that when the wear member 12 is in the mounted position, the fourth abutment surface 56 on the first abutment 50 is brought adjacent the third abutment surface 81 of the first notch 76 and the second abutment 58 of the second abutment 52 is brought adjacent the open side of the retainer opening 82. Also, the retainer passage 44 in the wear member 12 is positioned in alignment with the retainer opening 82 in the mounting base. Furthermore, each of the sides 70,72 of the mounting base 20 are positionable in close abutting relationship to their respective abutment surfaces 42 on the sides of the pocket 34 of the wear member 12. Such abutment surfaces 42 prevent lateral movement of the wear member 12 and are adapted to serve as abutments for transferring lateral forces from the wear member 12 into the parent member 14. As a result, movement of the wear member 12 is restricted in any direction other than in a direction of movement, shown by arrow 99, opposite to the transverse direction 98.

Upon insertion of the retainer 24 into the retainer opening 82 of the mounting base 20 through the retainer passage 44 in the wear member 12, one side 106 of the retainer 24 abuts the first abutment surface 88 of retainer opening 82 of the mounting base 20, while the opposite side 108 of the retainer abuts the second abutment surface 58 of the second abutment 52 of the wear member 12, thus preventing movement in the direction of movement shown by arrow 99 and thereby retaining the wear member 12 to the mounting base 20. Also, such first and second abutment surfaces 88,58 are disposed in spaced opposing relationship to a respective one of the opposite sides 106,108 of the retainer 24 at a location under the outward surface 64 of the mounting base 20. In addition, the first and second abutment surfaces 88,58 engage their respective sides 106,108 in generally aligned opposition to each other, such that the retainer is loaded in compression, rather than in shear.

It should also be noted that the mounting base 20 has a predetermined thickness "$T_b$" between the inward surface 62 and the outward surface 64 and that the retainer opening 82 preferably extends entirely through the body portion 60 of the mounting base 20 such that the parent member 14 forms a bottom for the retainer opening. The thickness of the retainer 24 is preferably no greater than the thickness of the mounting base 20 such that the retainer does not protrude above the outward surface of the mounting base.

The wear member 12 has a predetermined height "H" above the parent member 14, whereas the retainer 24 has a predetermined thickness "$T_r$". As shown in the FIG. 2, the retainer is oriented flat such that the height of the retainer 24 above the parent member 14 is defined by its thickness in order to maximize the height of the wear member 12 as usable wear material. It is also important to note that the configuration and orientation of the present retainer 24 provides mechanical attachment system 10 of the present invention with a very low profile such that the wear member can be worn down to a lesser height before its replacement is required, thereby extending its wear life and reducing the amount of scrap which must be thrown away.

A second application of the present invention is depicted in FIGS. 14–17 wherein a mechanical attachment system 210 is provided for detachably mounting a wear member 212 in the form of a cutting edge wear member to a parent member 214 in the form of a bucket cutting edge of an earthmoving machine (not shown).

Like in the first application, the cutting edge 214 has a surface 218 to be protected from abrasive wear. The cutting edge 214 also has a forward edge surface 219. The system 210 also includes a mounting base 220, cooperating place and slide engagement elements 222 on each of the mounting base 220 and the wear member 212 to permit place and slide mounting of the wear member 212 onto the mounting base 220, and a retainer 224 for keeping the wear member 212 on the mounting base 220 during use.

A plurality of wear members 212 may be attached to a bucket. Typically such wear members are attached between a plurality of bucket teeth (not shown), which are disposed along the bucket cutting edge.

The wear member 212 includes a generally rectangular planar bottom body portion 226 that is disposed along a longitudinal axis 228, a mounting side 230 and an opposite wear exposed side 232. In this instance, the wear member also has a tapered ground engaging nose portion 231, with a rearwardly extending flange 233, which extends over the top of the cutting edge 214. The mounting side 230 preferably has a mounting base receiving pocket 234 formed therein. The pocket 234 has opposite, longitudinally extending sides 240,241 which have abutment surfaces 242 disposed therealong for transferring lateral side loads to the mounting base 220. A retainer passage 244 is provided through the body portion 226, extending from the wear exposed side 232 into the pocket 234. The retainer passage 244 has opposite sides 246,248 extending transversely to the longitudinal axis 228.

A first abutment 250 extends into the pocket 234 adjacent the retainer passage 244 and provides a second abutment surface 258. A second abutment 252 is formed by the nose portion and provides a fourth abutment surface 256. The abutment surfaces 258,256 are disposed in spaced opposing relationship to each other and are oriented in a direction transverse to the longitudinal axis 228. Abutment surface 258 is also aligned with one of the sides 248 of the retainer passage 244 of the wear member 212.

A first set of interlocking surfaces 253 are provided for use in attaching the wear member 212 to the mounting base 220, which form part of the place and slide engagement 222. Such interlocking surfaces 253 are preferably provided in the form of an external set of dovetail surfaces 254 on the first abutment 250 and a similar set of dovetail surfaces 255 extending from the sides 240,241 of the pocket 234.

The mounting base 220 (FIG. 16) is carried on the parent member 214 and includes a generally planar rectangular body portion 260 disposed along the longitudinal axis 228. The mounting base 220 has an inward surface 262 contacting the exposed surface 218 of the parent member 214, an opposite outward surface 264, a pair of opposite ends 266,268 transverse to the longitudinal axis and a pair of sides 270,272 parallel to the longitudinal axis. Preferably, the mounting base 220 is secured to the parent member by welding. To facilitate such welding, the mounting base 220 may be provided with a rectangular weld opening 275 therethrough for receiving fillet welds.

A retainer opening 282 and a contiguous abutment opening 278 are provided through the mounting base 220. The retainer opening 282 is disposed between the first abutment 250 and the second abutment 252. The retainer opening 282 has a first abutment surface or side 288 opposing the abutment opening 278, a pair of opposite ends 290,292 and a pair of opposed catch elements, one of which is shown at 284. The catch elements 284 are preferably formed by an inwardly extending flange 294 on each of the ends 290,292 for use in retaining a retainer in the retainer opening.

The mounting base 220 is provided with a second set of interlocking surfaces 279. Such interlocking surfaces are preferably by provided by a set of longitudinally extending internal dovetail surfaces 280 in the abutment opening 278 and another set of longitudinally extending internal dovetail surfaces 285 along the opposite sides 270,272, which are adapted to mate with the external dovetail surfaces 254,255 on the wear member 212.

The mounting base 220 is also provided with an upright flange portion 296 at the forward end 268. The forward face of the flange portion provides a third abutment surface 281 which is disposed in an opposing relationship to the fourth abutment surface 256 of second abutment 252. The flange portion 296 also has an inner abutment surface 298 on the side opposite surface 281 for transferring longitudinal digging loads into the cutting edge through edge surface 219.

A retainer 224 is adapted for placement within the retainer opening 282 of the mounting base 220 for retaining the wear member 212 to the mounting base 220 in the same manner as described for the first application. As such retainer 224 may be similar to any of the retainer embodiments previously shown and described, further description thereof will be reserved.

Industrial Applicability

The present mechanical attachment system 10,210 for detachably mounting the wear member 12 or 210 to the parent member 14,244 of an earthmoving machine provides several advantages. The main advantage of the system 10 is the quick and simple mounting of the wear member 12 onto the mounting base 20 and its subsequent removal, even in the worst of packing conditions. The installation may be accomplished without special tools other than a common screw driver or small pry bar and without any excessive amount of force being required. The place and slide arrangement allows the wear member to be placed on the mounting base and then slid into its mounted position where the cooperating place and slide engagement elements are engaged to hold the wear member as described earlier. Once in the mounted position, the retainer 24 may be inserted into the retainer passage 44. With one end of the retainer being positioned in the retainer opening under one of the flanges and the other end above the other flange, a pry bar may be inserted into the pry tool notch at the other end of the retainer. By applying a reasonably minimal force to the retainer with the pry bar, the retainer is sufficiently compressed in length to move the free end of the retainer past the other flange and seat the retainer fully within the retainer opening. Removal of the retainer is accomplished by reversing the preceding procedure.

Another primary advantage of the present system resides in closeness of the retainer to the parent member and its extremely low profile configuration which substantially increases the usable height of the wear member as wear material over prior known systems. In other words, the wear member can be worn down further before such wear reaches the retainer, which would necessitate the replacement of the wear member. Thus, less material is left to throw away when replacement is necessary, thereby reducing costs and waste. It should also be noted that the interlocking and abutment surfaces are likewise located close to the parent member to afford similar results.

Additionally, the system 10 also protects the interface of the mounting member 20 in the event the wear member 12 in not in position during operations. The notches and openings in the mounting base will pack with unearthed material and protect the interfacing surfaces from significant wear until a new wear member 12 can be installed.

In preparation of operation, the inward surface 62 of the mounting base 20 is positioned against the surface 18 of the parent member 14. A bead of weld is applied to the perimeter of the weld openings 74 fixedly attaching the mounting member 20 to the parent member 14.

Those skilled in the art will appreciate that while the present invention has been shown and described with respect to a wear tile application and a cutting edge protector for a bucket of an earthmoving machine, other suitable applications will readily come to mind as well. For instance, the present mechanical attachment system would be easily adapted for use as a bucket corner guard, for bucket tips and adapters and for wear tile on the bedliners of trucks and the like, all of which is contemplated and considered to fall within the scope of the present invention.

Other aspects, objects and advantages of this invention can be obtained from a study of the drawings, the disclosure and the appended claims.

We claim:

1. A mechanical attachment system for detachably mounting a wear member to a parent member of an earthmoving machine, comprising:

a mounting base carried on said parent member, and having an outward surface, a retainer opening in said outward surface and a pair of opposed catch elements;

said wear member having a retainer passage therethrough, which is alignable with said retainer opening in said mounting base;

cooperating place and slide engagement elements on each of said mounting base and said wear member to permit place and slide mounting of said wear member onto said mounting base, said place and slide engagement elements including a first abutment surface on said mounting base and a second abutment surface on said wear member; and a retainer having a pair of opposite sides and a convoluted spring portion, said retainer being adapted for receipt through said retainer passage and said spring portion providing said retainer with sufficient resiliency to permit the insertion of said retainer into said retainer opening, wherein said retainer is engaged and retained by said catch elements and wherein said first and second abutment surfaces are disposed in spaced opposing relationship to each other and have an abutting relationship to a respective one of said opposite sides of said retainer at a location under said outward surface of said mounting base.

2. The attachment system of claim 1, wherein said wear member has a predetermined height above said parent member and said retainer has a predetermined thickness and wherein said retainer is oriented in said retainer opening such that the height of the retainer above said parent member is defined by its thickness in order to maximize the height of the wear member as usable wear material.

3. The attachment system of claim 1, wherein said mounting base has a planar body portion having an inward surface disposed against said parent member and a predetermined thickness between said inward surface and said outward surface of said mounting base and said retainer opening extends entirely through said body portion such that said parent member forms a bottom for said opening, and wherein said retainer has a predetermined thickness that does not exceed the thickness of said body portion such that said retainer does not protrude above said outward surface of said mounting base.

4. The attachment system of claim 1, wherein said first and second abutment surfaces engage their respective sides of the retainer in generally aligned opposition to each other, whereby said retainer is loaded in compression, rather than in shear.

5. The attachment system of claim 1, wherein said cooperating place and slide engagement elements further include a fourth abutment surface and a first set of interlocking surfaces on said wear member and a third abutment surface and a second set of mating interlocking surfaces on said mounting base such that when said wear member is placed onto said mounting base by movement in one direction and then slid in a transverse direction thereto said abutment surfaces are brought together to prevent further movement in said transverse direction and said interlocking surfaces are brought into an opposing interlocking relationship with each other whereby movement of said wear member is restricted in any direction other than a direction of movement opposite to said transverse direction.

6. The attachment system of claim 1, wherein said retainer has a pair of opposite ends and a pair of opposite sides and wherein said convoluted spring portion is adapted to provide said retainer with sufficient resiliency in a direction transverse to said direction of movement to permit the length of said retainer to be changed from a predetermined free length from end to end to a shorter compressed length when a compressive force is applied to said ends of the body portion, but being sufficiently rigid from side to side to enable said retainer to withstand compressive loads applied to said opposite sides of the retainer without incurring any significant distortion.

7. The attachment system of claim 1, wherein said retainer has a longitudinal axis from end to end and said convoluted spring portion has a convolute that runs back and forth from one side of said retainer to the other side thereof as it progresses along said longitudinal axis.

8. The attachment system of claim 7, wherein said convolute is formed by a plurality of interleaved slots cut into said retainer, with a first set of said slots extending from one of said sides toward the other and with a second set of said slots being disposed between adjacent ones of said first set of slots and extending from the other of said sides toward to the one of said sides.

9. The attachment system of claim 6, wherein said retainer opening has a side oriented transverse to said direction of movement and provides said first abutment surface, and a pair of opposite ends, said ends being spaced apart a sufficient distance to accommodate the predetermined free length of said retainer therebetween, and wherein said catch elements are provided by a pair of flanges disposed adjacent the outward surface of said mounting base, one of said flanges extending inwardly from a respective one of said opening ends over a respective one of the ends of said retainer.

10. The attachment system of claim 1, wherein said retainer opening in said mounting base includes a contiguous abutment opening and wherein said place and slide engagement elements include a third abutment on said wear member that is disposed to extend into said abutment receiving opening of said retainer opening and provides said second abutment surface thereon, which is disposed in spaced opposing relationship to said first abutment surface on said mounting base.

11. The attachment system of claim 1, wherein said parent member is a bottom base edge of an earthmoving bucket, said base edge having a front cutting edge and a bottom surface extending rearwardly from said cutting edge.

12. The attachment system of claim 11, wherein said wear member is a cutting edge protector, said edge protector having a tapered nose portion and a rearwardly extending lower mounting portion, and said mounting base has a planar mounting portion and an upright flange portion at a forward end of said mounting portion, said flange portion having a rearward face positionable in abutment against said cutting edge and a forward face positionable in abutment with said tapered nose of said edge protector such that digging forces oriented perpendicular to said faces are carried from said edge protector into said cutting edge through said flange portion of said mounting base.

13. The attachment system of claim 12, wherein said wear member is a wear tile and said mounting base is attached to said bottom surface of said base edge at a location to the rear of said cutting edge thereof, said mounting base having a generally rectangular planar body portion.

14. The attachment system of claim 13, wherein said wear member has a mounting side and an opposite wear exposed side, said mounting side having a mounting base receiving pocket formed therein, and wherein said retainer passage extends from said wear exposed side into said pocket.

15. A wear member for protecting a parent member of an earthmoving machine from abrasive wear, comprising:

a body portion disposed along a longitudinal axis, a mounting side and an opposite wear exposed side, said mounting side having a mounting base receiving pocket formed therein, said pocket having opposite ends spaced apart along said longitudinal axis;

a retainer passage therethrough extending from said wear exposed side into said pocket, said retainer passage having opposite sides extending transversely to said longitudinal axis;

cooperating place and slide engagement elements to permit the mounting of said wear member onto a mounting base carried on said parent member, said place and slide engagement members including a first abutment disposed adjacent one end of said pocket and a second abutment disposed adjacent the opposite end of said pocket, said abutments being centrally located along said longitudinal axis and with said retainer passage being disposed therebetween, each abutment having a set of external dovetail surfaces on opposite sides thereof for use in attaching said wear member to said mounting base and one of a pair of opposing surfaces, said opposing surfaces being disposed in spaced opposing relationship to each other and oriented in a direction transverse to said longitudinal axis, one of said pair of opposing surfaces being aligned with one of the sides of said retainer passage.

16. A low profile retainer for mechanically attaching a wear member to a parent member of an earthmoving machine, comprising:

a generally flat body portion having a pair of opposite ends and a pair of opposite sides;

a convoluted spring portion along said body adapted to provide said body with sufficient resiliency to permit the length of said body to be changed from a predetermined free length from end to end to a shorter compressed length when a compressive force is applied to said ends of the body, but being sufficiently rigid from side to side to enable said retainer to withstand compressive loads applied to said sides without incurring any significant distortion.

17. The retainer of claim 16 wherein said retainer has a longitudinal axis from end to end and said convoluted spring portion has a convolute that runs back and forth from one side of said retainer to the other side thereof as it that progresses along said longitudinal axis.

18. The retainer of claim 17 wherein said convolute is formed by a plurality of interleaved slots cut into said body portion, with a first set of said slots extending from one of said sides toward the other and with a second set of said slots being disposed between adjacent ones of said first set of slots and extending from the other of said sides toward to the one of said sides.

19. A mounting base for use in detachably mounting a wear member to an exposed surface of a parent member of an earthmoving machine, comprising:

a generally planar rectangular body portion having an inward surface contacting said exposed surface of the parent member, an opposite outward surface, a pair of opposite ends parallel to a lateral axis of said body portion and a pair of sides parallel to a longitudinal axis of said body portion, each of said sides having portions thereon adapted to serve as abutments for transferring lateral forces from said wear member into said parent member;

a first notch at one end of said body and a second notch at the opposite end of said body, each of such notches having opposite ends with internal dovetail surfaces for use in attaching said wear member to said mounting base; and a retainer opening contiguous to one of said notches and having a side opposing said notch and a pair of opposite ends, each of said ends having an inwardly extending flange for use in retaining a retainer in said retainer opening.

20. A mechanical attachment system for detachably mounting a wear member to a parent member of an earthmoving machine, comprising:

mounting base carried on said parent member, and having an outward surface, a retainer opening in said outward surface and a pair of opposed catch elements;

cooperating place and slide engagement elements on each of said mounting base and said wear member to permit place and slide mounting of said wear member onto said mounting base, said place and slide engagement elements including a first abutment surface on said mounting base and a second abutment surface on said wear member; and a retainer having a pair of opposite sides and a convoluted spring portion, said spring portion providing said retainer with sufficient resiliency to permit the insertion of said retainer into said retainer opening, wherein said retainer is engaged and retained by said catch elements and wherein said first and second abutment surfaces are disposed in spaced opposing relationship to each other and have an abutting relationship to a respective one of said opposite sides of said retainer at a location under said outward surface of said mounting base.

* * * * *